US005102311A

United States Patent [19]

Lambeck

[11] Patent Number: 5,102,311

[45] Date of Patent: Apr. 7, 1992

[54] INTEGRAL PRESSURE PULSE ATTENUATOR

[75] Inventor: Raymond P. Lambeck, Bloomfield Hills, Mich.

[73] Assignee: General Motors Corporation, Detroit, Mich.

[21] Appl. No.: 433,255

[22] Filed: Nov. 8, 1989

[51] Int. Cl.[5] ..... F04B 11/00

[52] U.S. Cl. ..... 417/540; 138/30

[58] Field of Search ..... 417/540; 138/30

[56] References Cited

U.S. PATENT DOCUMENTS

| | | | |
|---|---|---|---|
| 1,952,994 | 3/1934 | Laird | 417/540 X |
| 2,811,925 | 11/1957 | Crookston | 417/540 X |
| 3,192,864 | 7/1965 | Notte | 417/540 |
| 4,220,376 | 9/1980 | Spero | 303/87 |
| 4,264,287 | 4/1981 | Ishida et al. | 417/540 |
| 4,514,151 | 4/1985 | Anders | 417/540 |

FOREIGN PATENT DOCUMENTS

| | | | |
|---|---|---|---|
| 3610173 | 10/1986 | Fed. Rep. of Germany | 417/540 |

OTHER PUBLICATIONS

Two unnumbered and undated pages from an advertising brochure.

*Primary Examiner*—Robert G. Nilson
*Attorney, Agent, or Firm*—Saul Schwartz

[57] ABSTRACT

An integral pulse attenuator on a high pressure axial piston hydraulic pump includes a frustoconical cavity in boss on a valve block of the pump, a cover over the cavity, a complementary frustoconically shaped flexible bladder in the cavity dividing the latter into variable volume fluid and gas chambers on opposite sides of the bladder, and a plurality of attenuator passages through a web of the valve block from a discharge port of the pump to the fluid pressure chamber in the cavity. When the pump is on, pressure pulses migrate from the discharge port to the fluid pressure chamber and are damped by oscillations of the bladder. When the pump is off, the cavity reinforces the bladder against gas pressure of about 1500 psi in the gas chamber to prevent distortion of the bladder.

1 Claim, 1 Drawing Sheet

INTEGRAL PRESSURE PULSE ATTENUATOR

FIELD OF THE INVENTION

This invention relates to pressure pulse attenuators for high pressure axial piston hydraulic pumps.

BACKGROUND OF THE INVENTION

An active ride automobile suspension system currently under consideration features a hydraulic system including an axial piston pump discharging fluid at between about 1000 psi and 3000 psi and at flow rates of between 0 and 30 GPM. In prior systems characterized by comparable pressures and flow rates, pressure pulses emanating from the pump have been absorbed or damped by in-line attenuators such as the SUPPRESSOR models manufactured by Wilkes & McLean of Barringtom, Ill. These devices are not attractive for automotive applications, however, because they are relatively heavy and bulky. Smaller pressure pulse attenuators have been used in relatively lower pressure and/or lower flow rate applications but are unsuitable for the active ride application for durability and/or performance reasons. In an automotive fuel injection application, for example, a fuel pump has been proposed wherein a damping or attenuation chamber having one wall defined by a spring biased diaphragm is integrated into the fuel pump housing. When the pump is on, fuel discharge pressure on one side of the diaphragm balances spring force on the other side. When the pump is off, the spring expands until the tension in the diaphragm balances the spring force. A pressure pulse attenuator according to this invention incorporates structural features for durability in high pressure environments and for maximum compactness and is particularly suited for the active ride application.

SUMMARY OF THE INVENTION

This invention is a new and improved pressure pulse attenuator particularly for a fluid system in which an axial piston pump delivers fluid at working pressures of up to about 3000 psi at flow rates up to about 30 GPM and in which pressure pulses of about ±100 psi at 100 to 1500 Hz frequency emanate from the pump. The attenuator according to this invention includes a frustoconical attenuator cavity on a valve block of the pump. The bottom of the cavity is separated from a discharge port of the pump by a web of the valve block. A complementary shaped frustoconical flexible bladder is disposed in and bears against the attenuator cavity. A cover on the valve block closes the attenuator cavity and has a fitting for introducing gas under high pressure of on the order of 1500 psi into a gas chamber defined between the bladder and the cover. When the pump is off, the complementary shape of the cavity relative to the bladder reinforces the latter against distortion by the high gas pressure on one side of the bladder. A plurality of attenuator passages through the web conduct high pressure fluid from the pump discharge port to a fluid chamber defined between the bladder and the attenuator cavity. When the pump is on, the bladder flexes as high pressure fluid in the fluid chamber expands the latter against the pressure in the gas chamber. At equilibrium, the middle of the bladder is suspended generally mid-way between the cover and the bottom of the cavity and oscillates through small excursions to damp or absorb the pressure pulses emanating from the pump.

DESCRIPTION OF THE PREFERRED EMBODIMENT

Figure 1:
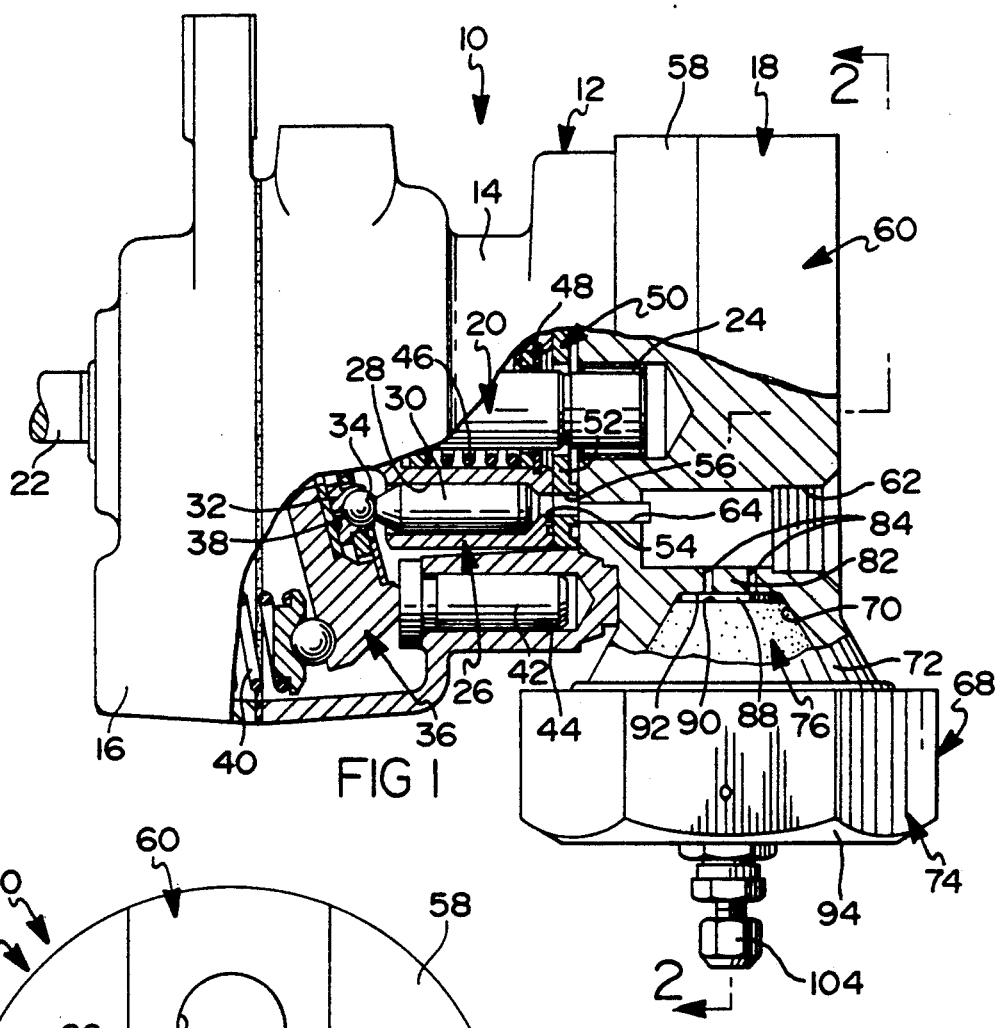
FIG. 1 is a partially broken-away elevational view of a pressure pulse attenuator according to this invention on a variable displacement axial piston hydraulic pump.

Referring to FIG. 1, a variable displacement axial piston hydraulic pump 10 has a case 12 which includes a center housing 14, a mounting flange 16 bolted to one end of the center housing 14, and a valve block 18 bolted to the other end of the center housing. Holes, not shown, in the mounting flange 16 provide attaching locations for mounting the pump 10 on an appropriate support. A drive shaft 20 of the pump has an exposed end 22 outside the case 12 and is rotatably supported on the case by a needle bearing 24 on the valve block and a ball bearing, not shown, on the mounting flange. The exposed end 22 of the drive shaft receives a pulley or the like for driving the pump.

A barrel 26 on the drive shaft 20 rotates with the latter and has a plurality of cylindrical piston bores therein parallel to and symmetrically arrayed around the drive shaft, only a single bore 28 being illustrated in FIG. 1. The piston bores have respective ones of a plurality of axial pistons slidably disposed therein, only a single piston 30 in the bore 28 being shown in FIG. 1. Each piston has a bearing shoe 32 universally articulated to it at a spherical connector 34.

With continued reference to FIG. 1, the pump 10 further includes a ring-shaped tilt-yoke 36 in the center housing 14 around the drive shaft 20. The bearing shoes 32 bear against and slide relative to an annular surface 38 on the tilt-yoke. The tilt-yoke is supported on the case 12 for pivotal movement about an axis perpendicular to the drive shaft 20 to vary the stroke of the pistons 30.

A spring 40 between the mounting flange 16 and the tilt-yoke 36 biases the latter toward its maximum stroke position. A control piston 42 in a bore 44 in the center housing 14 opposes the spring 40 and changes the inclination of the tilt-yoke in accordance with a control pressure introduced into the bore 44. The control pressure is supplied by a conventional compensator valve, not shown, conveniently mounted on the valve block.

A spring 46 seating on a retainer 48 on the barrel and on a shoulder, not shown, on drive shaft 20 captures a flat, circular valve plate 50 between an end wall 52 of the barrel 26 and a facing side 54 of the valve block 18. The valve plate is doweled or otherwise non-rotatably connected to the valve block and has a pair of arc-shaped slots therethrough for conducting fluid to and from the piston bores on the barrel, only a portion of a slot 56 for conducting high pressure fluid discharge from the piston bores being illustrated in FIG. 1.

Figure 2:
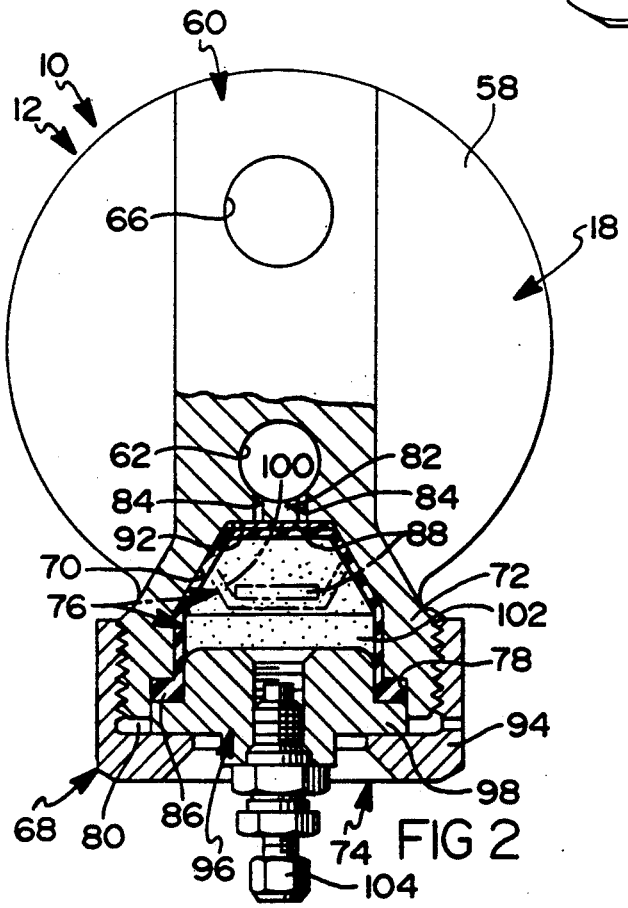
FIG. 2 is a partially broken-away view taken generally along the plane indicated by liners 2—2 in FIG. 1.

As seen best in FIGS. 1 and 2, the valve block 18 includes a generally circular body 58 on which the facing side 54 is formed and an integral rectangular boss 60. A threaded counterbore 62 in the boss 60 defines a high pressure discharge port of the pump connected to the slot 56 in the valve plate by a passage 64 in the valve block. A similar counterbore 66 in the boss 60, FIG. 2, defines a low pressure inlet port of the pump.

The pump 10 operates in conventional fashion. Particularly, the pistons 30 discharge high pressure fluid through the slot 56 in the valve plate, the passage 64, and the discharge port 62 as each piston bore 28 achieves registry with the slot 56. Accompanying sequential registry between the piston bores and the slot are pressure pulses which propagate downstream from the discharge port. A pressure pulse attenuator 68 according to this invention, integral with the valve block 18, effectively damps the pulses.

The attenuator 68 includes a cavity 70 in an expanded end 72 of the boss 60 on the valve block, a cover 74, and a flexible bladder or diaphragm 76. The cavity 70 is preferably generally frustoconical, but may have other convenient shapes. A counterbore 78, FIG. 2, extends around the cavity 70 adjacent an open end 80 thereof. The cavity 70 is separated from the discharge port 62 by a web 82 of the valve block 18. One or more small diameter attenuator passages 84 traverse the web 82 between the discharge port 62 and the cavity 70.

Figure 3:
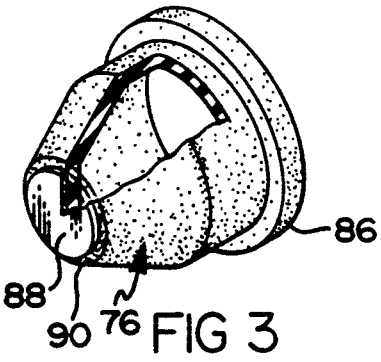
FIG. 3 is a partially broken-away perspective view of a flexible bladder of the pressure pulse attenuator according to this invention.

The bladder 76 is made of flexible material such as VITON which is impervious to conventional hydraulic fluids and can be molded with a suitable shape dimensionally complementary to the attenuator cavity 70. When the bladder 76 is seated in the cavity 70, an integral annular lip 86 on the bladder seats in the counterbore 78. A thin metal reinforcing disc 88 is affixed to an end wall 90 of the bladder, FIG. 3. The disc and the end wall 90 seat against a corresponding circular surface 92 of the cavity 70 through which extend the attenuator passages 84.

The cover 74 includes an annular, threaded, hex-shaped retainer 94 and a circular adapter 96 having an annular flange 98. The adapter 96 closes the open end of the bladder 76 and the flange 98 of the adapter seats against the lip 86 of the bladder. The retainer 94 is threaded onto the outside of the expanded end 72 of the boss 60 and captures the lip 86 of the bladder between the retainer annular flange 98 and the counter bore 78 in gas-tight and fluid-tight fashion. The bladder 76 and the cavity 70 cooperate in defining therebetween a variable volume fluid chamber 100. The bladder 76 and the adapter 96 cooperate in defining therebetween a variable volume gas chamber 102. The gas chamber 102 is charged with high pressure gas through a valved fitting 104 on the adapter 96.

For operation on a pump having a normal working pressure of about 3000 psi and a normal flow capacity of about 15 GPM, the gas chamber 102 of the attenuator 68 is charged to about 1500 psi. When the pump is off, the pressure in the gas chamber vastly exceeds the pressure in the fluid chamber and presses the bladder 76 against the cavity 70 so that the volume of the fluid chamber 100 is minimal. The cavity reinforces the bladder and prevents distortion thereof which would otherwise occur due to the extreme pressure difference across the bladder. The metal disc 88 abuts the circular surface 92 of the cavity 70 over the attenuation passages 84 to foreclose extrusion of the bladder into the passages.

When the pump 10 is on, fluid at high pressure migrates through the attenuation passages 84 into the fluid chamber 100 of the attenuator. When the fluid pressure exceeds the initial charged pressure in the gas chamber 102, the fluid chamber 100 expands and the gas chamber contracts as the bladder flexes in rolling lobe fashion generally in the area of the conical portion of the bladder. At a normal working position 70' of the flexed portion of the bladder, illustrated in broken lines in FIG. 2, the fluid and gas pressures on opposite sides of the bladder are balanced. Thereafter, pressure pulses emanating from the pistons 30 migrate into the fluid chamber through the attenuator passages 84 and are damped by relatively small excursions of the flexed portion of the bladder against the pressure in gas chamber 102.

The low mass inertia of the bladder 76 permits high frequency response of the attenuator and is, therefore, an important feature of this invention. That is, because the cavity reinforces the bladder against distortion when the pump is off, the bladder can be made with a thin enough wall section in the vicinity of its rolling lobe to afford acceptable frequency response. Otherwise, the corresponding wall section of the bladder would necessarily be thicker to withstand the pressure difference when the pump is off and, therefore, less responsive. The integration of the attenuator 70 into the valve block 18 such that the attenuator passages 84 extend directly from the discharge port 62 to the cavity 70 is, likewise, an important feature of this invention because initial test data suggests superior damping is achieved in comparison to systems having non-integral attenuators further downstream from the discharge port.

The embodiments of the invention in which an exclusive property of privilege is claimed are defined as follows:

1. An integral pressure pulse attenuator for a high pressure hydraulic pump including a plurality of axially reciprocating pistons and a valve block having a discharge port therein defined by a passage in said valve block parallel to the direction of reciprocation of said pistons, said integral pressure pulse attenuator comprising:

means defining a cavity in said valve block symmetrical about a centerline perpendicular to said passage in said valve block defining said discharge port and having an open end and a wall separated from said discharge port by a web of said valve block, means defining an annular shoulder in said cavity adjacent said open end thereof, a flexible bladder in said cavity having a normal shape complementary to the shape of said cavity and an annular lip seated on said annular shoulder of said cavity, a circular adapter seated on said annular lip of said bladder and closing said open end of said cavity so that said cavity and said bladder cooperate in defining a variable volume fluid chamber on a first side of said bladder and said bladder and said adapter cooperate in defining a variable volume gas chamber on a second side of said bladder opposite said first side, means defining an externally threaded boss on said valve block around said cavity therein, an annular retainer screwed onto said threaded boss over said adapter to capture said adapter on said valve block and seal said annular lip of said bladder between said adapter and said annular shoulder of said cavity, means on said adapter for introducing gas under high pressure into said variable volume gas chamber, means defining an attenuator passage in said web of said valve block perpendicular to said passage in said valve block defining said discharge port between said discharge port and said wall of said cavity whereby pressure pulses in said discharge port are conducted into said variable volume fluid chamber, and a metal reinforcing member attached to said bladder opposite said wall of said cavity and seating on said wall of said cavity over said attenuator passage when said pump is off.

* * * * *